United States Patent [19]

Shumaker

[11] 4,365,428

[45] Dec. 28, 1982

[54] BUCKET MOUNTED FOOTING TOOL

[75] Inventor: John F. Shumaker, Mt. Pleasant, Iowa

[73] Assignee: J. I. Case Company, Racine, Wis.

[21] Appl. No.: 209,540

[22] Filed: Nov. 24, 1980

[51] Int. Cl.[3] ..... E02F 5/02

[52] U.S. Cl. ..... 37/103; 37/141 R

[58] Field of Search ..... 37/103, 98, 117.5, 141 R, 37/141 T, DIG. 3

[56] References Cited

U.S. PATENT DOCUMENTS

| | | | |
|---|---|---|---|
| 2,783,558 | 3/1957 | Morgan | 37/103 |
| 3,307,277 | 3/1967 | Kondracki | 37/141 R |
| 3,724,899 | 4/1973 | Clark | 37/117.5 X |
| 4,125,952 | 11/1978 | Jennings | 37/117.5 |

FOREIGN PATENT DOCUMENTS

| | | | |
|---|---|---|---|
| 756480 | 6/1952 | Fed. Rep. of Germany | 37/117.5 |

*Primary Examiner*—E. H. Eickholt

*Attorney, Agent, or Firm*—Dressler, Goldsmith, Shore, Sutker & Milnamow, Ltd.

[57] ABSTRACT

A tool adapted to be removably joined to the bucket or dipper stick of a backbone or excavator is described. The tool is used to dig a footing at the base of a trench. The tool includes two major components: a frame and a tooth-shaped member. The frame carries a tooth-shaped member and the frame is removably joined to the bucket. The tooth-shaped member engages and uplifts the material at the base of the trench while the frame guides the tooth-shaped member and funnels the material uplifted from the base of the trench into the interior of the bucket. The tooth-shaped member can be formed together in one solid piece or from several flat plates that have been welded together. A bolting means can be used to join the tooth-shaped member and frame to the bucket.

4 Claims, 7 Drawing Figures

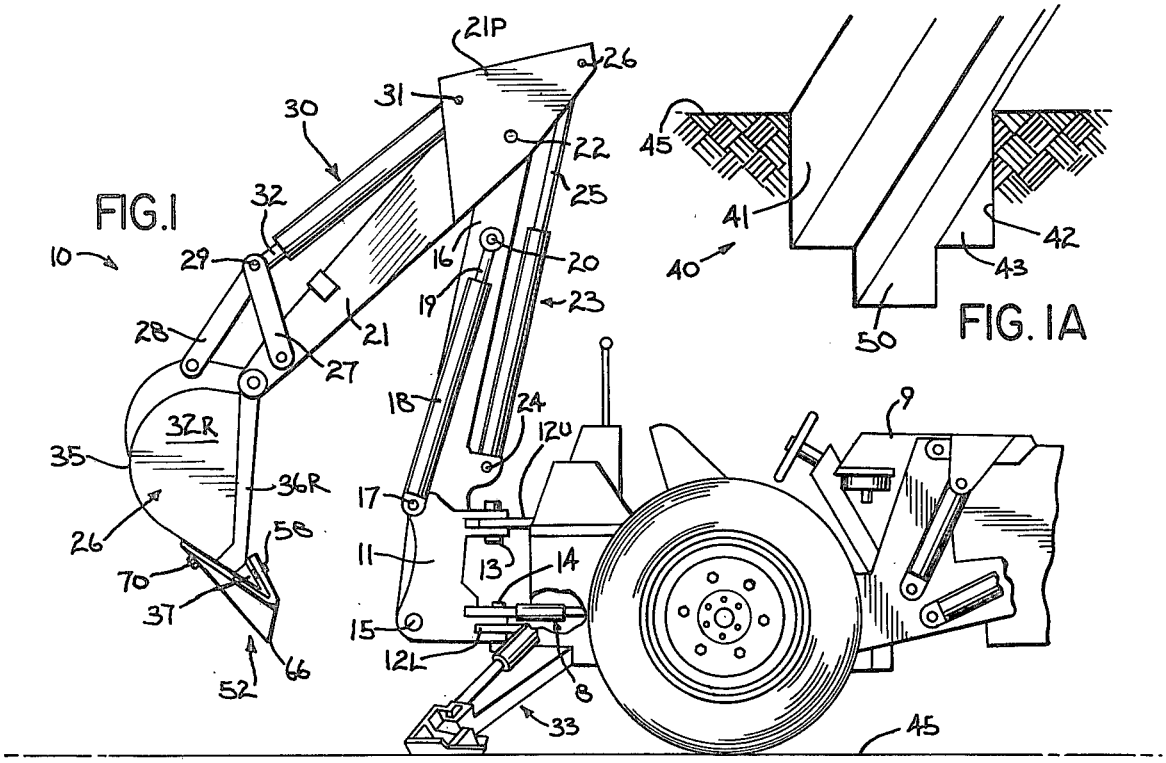
FIG.1
10
21P
26
31
30
22
25
32
29
16
20
19
23
28
21
27
18
24
12U
32R
35
36R
17
26
58
11
13
14
70
37
15
12L
66
52
8
33
45
9
45
41
42
40
43
50
FIG. 1A
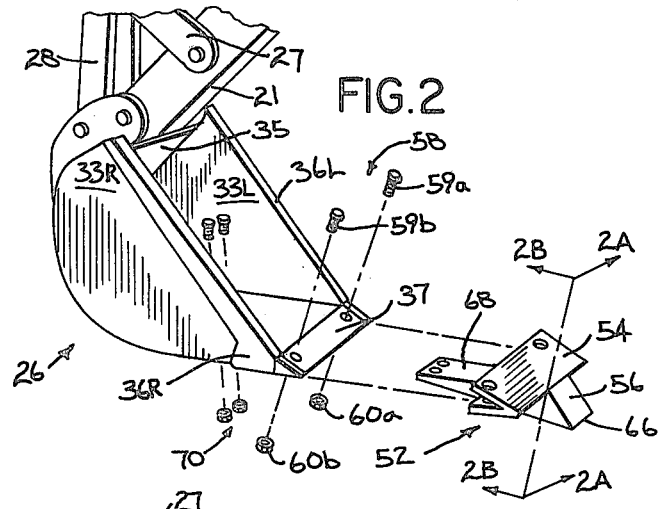
FIG.2
28
27
21
35
58
33R
33L
36L
59a
59b
2B
2A
37
68
54
26
36R
56
60a
66
70
60b
52
2B
2A
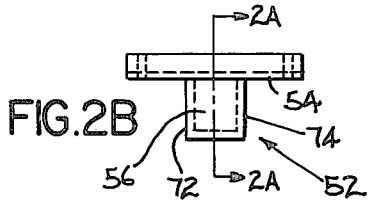
FIG.2B
2A
54
74
56
72
2A
52
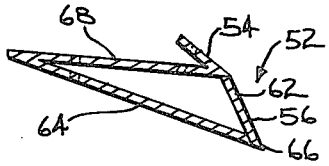
68
54
52
62
56
64
66
FIG.2A
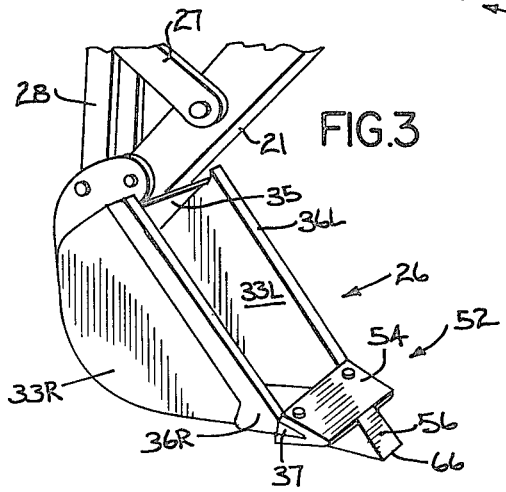
FIG.3
27
28
21
35
36L
26
33L
54
52
33R
56
36R
66
37
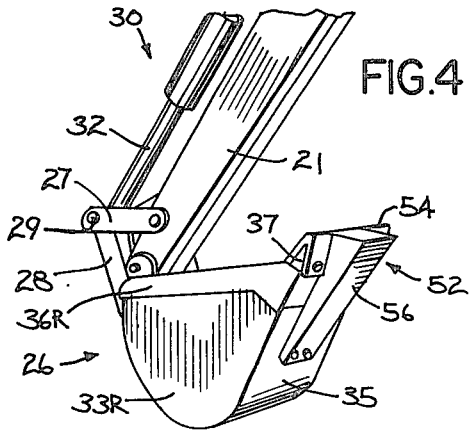
FIG.4
30
32
21
27
54
29
37
28
52
36R
56
26
33R
35

BUCKET MOUNTED FOOTING TOOL

TECHNICAL FIELD

The present invention relates to tools and devices mounted on a bucket and, more particularly, to those tools and devices used in conjunction with a backhoe or a tractor hoe when digging a trench.

BACKGROUND OF THE INVENTION

The simplest type of drainage by underground tiling is constructed by excavating a trench, smoothing the bottom to the desired gradient, butt joining the drain tiles together and then back filling the trench. Water from the affected area drains into the tiles through the joints, and, to a lesser extent, through any openings in the walls, and then flows inside the tiles to the drain outlet. Under favorable conditions, such an elementary drain system can function for a very long period of time. However, dirt falling into the tiles through the joints or entering the drain system with the water may fill or plug low spots left by the subsidence of the bottom of the trench.

A better drain system employs a base of an aggregate, such as gravel, upon which the tiles are laid. This provides a firmer foundation or footing for the tiles. In addition, the footing provides a porous space into which dirt or silt can empty through the joints from the pipe. This storage space for silt may fill so that the pipe itself will ultimately fill with silt. However, the footing of gravel serves to trap the dirt brought into the drainage system during the initial period of adjustment after the system is installed. After this adjustment or settling period, it has been observed that little or no dirt flows into the drainage system.

A relatively large amount of land and drain tile is used in farm land applications. The work is usually done on a fairly large scale, on regular grades, and with adequate space. Costs must generally be kept to a minimum if the installation is to be economically justified at all. Ditching machines, backhoes, and excavators are particularly adapted to this kind of work. However, the rate of digging depends on a number of variables, including: depth and width of the trench, bucket size and efficiency, cycle time of the backhoe or excavator, the quality of the soil to be removed, obstacles and hazards both above and below ground, the presence of rock, the accuracy of the grade required, and the need for separating top soil. For a given site and drain system, the bucket size and efficiency are the only variables that can be readily controlled by the backhoe operator.

Small machines, with buckets as narrow as six or eight inches, may be used for drain pipe installations having a depth up to four feet. Buckets of that size produce the minimum excavation needed and insure adequate room for lining up the tile. As the maximum depth is approached greater difficulties are experienced. It becomes more and more difficult to locate drain tile accurately. It is also very difficult to remove earth and rock that falls from the sides of the trench into the bottom of the trench. Accurate gravel placement within the footing or around the tile also becomes inconvenient. A wider bucket per se will eliminate some of these difficulties but more dirt will have to be excavated from the beginning and more backfill applied after the tiles are laid. This raises the cost of the installation. Thus, a mere change in bucket size is not enough.

Typically a supply of tile is laid on the field, parallel with the trench line, just far enough to clear the excavator or backhoe, on the side away from the intended spoil pile. The pieces of tile are laid end-to-end to give the correct number, with a few extra placed at frequent intervals to make up for broken and imperfect tiles. Next the footing is dug into the bottom or base of the trench. If the pipe or tiles are small the footing may be dug manually. However, if the tiles are small and the trench is deep, that may be impossible to do. Consequently, a machine is almost always used to dig the footing. Conventionally this is done by changing the size of the bucket or using a second backhoe with a smaller bucket. Regardless of the option selected costs are increased, either due to the slower rate of laying tile if the bucket is periodically changed, or due to the need to employ a second machine and a second machine operator.

After the footing is dug, the footing is filled with gravel or crushed stone. This material is usually supplied by a dump truck with a small opening in the rear gate. The truck straddles the ditch as the gravel is applied. Next the layer of stone or gravel is smoothed off. Finally, the tile is placed on the trench bottom as soon as possible to minimize the danger of "losing" the trench through caving-in of the sides.

Thus, it should be apparent that the basic trench digging and tile laying procedure just described has room for improvement. If something could be provided that would simplify the procedure or improve the utilization of the machinery used to dig the trenches and the footing for drain tiles, the overall productivity of the backhoe or excavator used to dig the trench would be improved. More importantly, the overall cost of the drainage system would be reduced.

SUMMARY OF THE INVENTION

In accordance with the invention that is the subject of this application, an apparatus is provided for digging a footing at the base of a trench into which a drain pipe or tile is to be inserted. The apparatus is carried by the bucket used to excavate or dig the trench. The bucket is attached to and actuated by an implement such as the dipper stick of an excavator or a backhoe. In addition to the bucket, the apparatus or footing tool is comprised of two major components: a frame and a footing means. The frame is removably joined to the bucket and the footing means is in turn carried by the frame.

The footing means engages the base or bottom of the trench in such a manner as to break loose a portion of the material (soil and rock) forming the base. The footing means defines a pointed leading edge that is downwardly disposed in advance of or ahead of the leading edge of the bucket to which the footing means is attached. The width of the leading edge of the footing means is less than the width of the leading edge of the bucket. When the footing means and frame are joined to the bucket and when the bucket is positioned along the base of the trench and then thrust into the trench by the backhoe or excavator, a portion of the base of the trench is broken loose by the footing means in such a manner as to form an elongated generally rectangular channel at the bottom of the trench. The material broken loose by the footing means is funneled into the bucket by the motion of the dipper stick attached to the bucket. The bucket collects the material loosened by the footing means and prevents that material from falling back into the channel dug by the footing means.

The frame portion of the apparatus includes a complementary portion that fits over the leading edge of the bucket. The complementary portion directs that part of the base of the trench broken loose by the footing means into the interior of the bucket. The frame also includes a guiding means that rests along the base of the trench and holds or maintains the leading edge of the footing means at a relatively fixed distance below the base of the trench.

Several methods can be used to fabricate the footing means. In one embodiment the footing means is essentially a solid, one-piece structure resembling a large wedge-shaped tooth. In another embodiment the footing means is formed from several generally flat rectangular plates. Two plates are joined together at an acute angle to form the leading edge of the footing means. The opposite end of one of the plates is disposed along the leading edge of the bucket. The opposite end of the other plate is disposed along the back wall of the bucket at a position behind the leading edge of the bucket. The leading edge of the footing means is downwardly disposed in advance of or ahead of the leading edge of the bucket. Two additional plates can be added to either side of the two plates forming the leading edge of the bucket. These two additional plates form the side walls of the footing means. When so added, the footing means resembles a hollow, wedge-shaped box.

The footing means is carried by the frame and the frame is removably connected to the bucket by threaded fasteners, such as ordinary nuts and bolts. When so attached to the bucket, the footing means allows the operator of a backhoe to dig a generally rectangular channel at the base of a trench. The channel can then be filled with gravel or stones so as to form a footing or base for the drain pipe or tile that will be installed in the trench. The footing tool can also be used while the bucket is digging the trench. For that matter, it can be integrally formed with the bucket.

Thus, the apparatus enables the operator of a backhoe or excavator to install drain pipe at an increased rate without having to change the bucket to one of a smaller size without having to employ manual labor to dig the footing for the drain pipe, and without having to employ more than one excavating machine. Numerous other advantages and features of the present invention will become readily apparent from the following detailed description of the invention and from the embodiments illustrated therein, from the claims, and from the accompanying drawings.

BRIEF DESCRIPTION OF THE DRAWINGS

FIG. 1 is a partial, side, elevational view of a backhoe mounted on a tractor and having the tool that is the subject of the present invention attached to its bucket;

FIG. 1A is a partial, perspective view of a trench and with a footing dug by the tool illustrated in FIG. 1;

FIG. 2 is a fragmentary, perspective, exploded illustration of the manner in which the footing tool is attached to the bucket of the backhoe shown in FIG. 1;

FIG. 2A is a cross-sectional, side, elevational view of the footing tool illustrated in FIG. 2 as viewed along line 2A—2A of FIG. 2;

FIG. 2B is a front, elevational view of the footing tool illustrated in FIG. 2 as viewed along line 2B—2B of FIG. 2;

FIG. 3 is a fragmentary, enlarged perspective view of the footing tool illustrated in FIG. 2 when attached to the bucket; and FIG. 4 is a fragmentary, enlarged perspective view of the bucket shown in FIG. 2, when the bucket has been curled inwardly, illustrating the lower portion of the footing tool.

DETAILED DESCRIPTION

While this invention is susceptible of embodiment in many different forms, there is shown in the drawings and will herein be described in detail several specific embodiments with the understanding that the present disclosure is to be considered as an exemplification of the principles of the invention and is not intended to limit the invention to those specific embodiments illustrated.

Turning now to the drawings, FIG. 1 illustrates one machine, a backhoe, upon which the apparatus that is the subject of the present invention can be installed. Specifically, a backhoe attachment, designated generally by 10, is shown pivotally mounted at the rear end of a tractor 9 (illustrated only fragmentarily.) The backhoe attachment 10 includes a support in the form of a swing tower 11 pivotally mounted on two rearwardly projecting tractor mounting brackets 12U and 12L by means of upper and lower swivel pins 13 and 14 which collectively define a common vertical axis. A swing cylinder or hydraulic actuator 8 rotates the swing tower 11 about its vertical axis. As is conventional, the swing tower 11 carries a bottom horizontal pivot shaft 15 mounting a boom 16 and two upper horizontal pivot shafts 17 that are used to mount two boom cylinders 18 (only one being shown). Each boom cylinder 18 is a double acting type that has a single ended piston rod 19 pivotally connected to a pivot shaft 20 located adjacent the free end of the boom 16.

A dipper stick 21 is mounted on a pivot shaft 22 carried at the free end of the boom 16. This pivot shaft 22 defines a pivot axis for the dipper stick 21 at a location intermediate the ends of the dipper stick, but substantially closer to the boom 16 end than to the bucket end of the dipper stick. The dipper stick 21 includes a rigid attachment plate or member 21P constituting its boom end. This member 21 receives the pivot shaft 22 used to join the dipper stick to the boom 16. A single dipper cylinder 23, also of the double acting type, is mounted on a pivot shaft 24 carried on the boom 16 adjacent its lower end. The dipper cylinder 23 has a single ended piston rod 25 pivotally connected to a pivot shaft 26 carried at the far end corner of the attachment plate 21P.

A bucket 26 is pivotally connected to the free end of the dipper stick 21 in the conventional manner. Specifically, a pair of drive links 27 and 28 are pivoted to the dipper stick 21 and to the bucket 26 respectively. These two drive links 27 and 28 are interconnected by a floating knee shaft 29. A bucket cylinder 30, also of the double acting type, is mounted on a pivot shaft 31 carried on an upstanding corner of the attachment plate 21P. The bucket cylinder 30 has a single ended piston rod 32 pivotally connected to the knee shaft 29. A set of outriggers 33 (only one being shown) are pivotally attached to the rear end of the tractor 9. The outriggers 33 improve the stability of the tractor when the backhoe 10 is placed in operation.

Referring to FIG. 2, the bucket 26 is formed from two side walls 33R and 33L and a back wall 35. The back wall 35 is positioned between the two side walls 33R and 33L. The forward edge of the back wall 35 defines the leading edge 37 of the bucket 26. The leading edge 37 of the bucket 26 is typically reinforced or strengthened since it is this edge of the bucket that bites into the earth when the backhoe is placed in operation. Similarly, each of the two free edges of the side walls 33R and 33L is reinforced with strengthening members 36R and 36L. The leading edge 37 of the bucket 26 may also be equipped to carry teeth or wedge-shaped protrusions which enable the bucket to be more easily driven into the earth. In general, the leading edge 37 of the bucket 26 has a generally wedge-shaped profile.

Referring to FIG. 1A, when the backhoe is placed in operation the bucket 26 may be used to dig a generally rectangular trench 40. The trench has two side walls 41 and 42 and a bottom or base 43. The depth of the trench 40 is defined as the vertical distance between the base of the trench 43 and the top of the trench or the grade 45. The width of the trench 40 is the distance between the two side walls 41 and 42. Generally speaking, once the width of the trench 40 is specified the size of the bucket 26 is determined. The bucket 26 is usually selected so that the trench 40 can be dug without having to change from a smaller to a larger bucket. Consequently, the width of the trench 40 is equal to the width of the bucket 26.

There are some situations where it is desirable to form a "footing" at an elevation below the level of the base 43 of the trench 40. For example, in some drain pipe installations, after the trench 40 has been dug, a generally rectangular, open-ended channel or footing 50 is dug below the level of the base 43 of the trench. The footing 50 is centered approximately between the two sidewalls 41 and 42 of the trench 40. After the footing 50 is dug, it is filled with an aggregate material, such as crushed stone or gravel, which not only supports the pipe or drain tile to be laid in the trench but also provides for draining the silt which leaks into the trench. Heretofore such a footing was dug either by changing the bucket 26 to one of a smaller width or by manual labor. Economically speaking, it is not desirable to fill the entire bottom of the trench 40 with gravel or crushed stone. Consequently, the footing 50 is relatively narrow in width and relatively shallow in depth. Preferably, the footing 50 should be dug using the same bucket that was used to form the trench 40. The footing tool that is the subject of the present invention enables one to do this.

FIG. 1 illustrates, a footing tool 52 installed over the leading edge 37 of the bucket 26. FIGS. 2, 3 and 4 are perspective views of footing tool 52. FIGS. 2A and 2B are cross-sectional and front elevational views of the footing tool 52. The footing tool 52 is formed from two major components: a frame 54, and a generally wedge or tooth-shaped member or footing means 56 that is downwardly disposed from the frame. Preferably, the frame 54 is removably joined to the bucket 26. The frame 54, in turn, carries the tooth-shaped member 56. The details of these two components will now be described.

The frame 54 serves three important functions: (1) it provides a means for attaching the tooth-shaped member or footing means 56 to the bucket 26; (2) it funnels or directs the material discharged or uplifted by the tooth-shaped member into the interior of the bucket 26; and (3) it guides or positions the tooth-shaped member at a fixed depth below the base 43 of the trench 40. As illustrated in the drawings, the frame 54 is a generally wedge-shaped member that is complementary to the leading edge 37 of the bucket 26. This complementary relationship is best illustrated in FIGS. 1 and 3. The frame 54 is joined to the bucket 26 by bolt means 58.

In the embodiments illustrated in the drawings, the bolt means 58 includes a pair of threaded fasteners or bolts 59*a* and 59*b* and a pair of complementary nuts 60*a* and 60*b*. Those skilled in the art should appreciate that there are many other methods which may be used to removably join or connect the frame 54 to the bucket 26. One advantage of using threaded fasteners is that the footing tool 52 can be readily attached or removed from the bucket 26 with ordinary (i.e. readily available) hand tools. It is conceivable under certain specialized operations that the footing tool 52 could be permanently mounted or attached to the bucket 26.

The tooth-shaped member or footing means 56 is carried by the frame 54. The tooth-shaped member may be formed as one solid piece integrally joined to the frame 54 or it may be fabricated from a number of flat metal plates. FIGS. 2A and 2B illustrate a tooth-shaped member or footing means 56 formed from flat metal plates. Specifically, two flat generally rectangular plates 62 and 64 are joined together at acute angle to form a generally V-shaped piece or member. The apex of the "V" formed by the two rectangular plates 62 and 64 defines the leading edge 66 of the footing tool 52. Welding is the preferred method for joining the two plates together. One 62 of the two rectangular plates forming the leading edge 66 of the footing tool 52 is joined to the frame 54. That plate 62 is disposed adjacent to the leading edge 37 of the bucket 26. The other plate member 64 forming the leading edge 66 of the footing tool 52 is disposed along the back wall 35 of the bucket 26. When the two plates 62 and 64 are so positioned, the leading edge 66 of the footing tool 52 is disposed forwardly and downwardly relative to the leading edge 37 of the bucket 26 when the bucket is resting along the base 43 of the trench 40.

The two rectangular plates 62 and 64 defining the leading edge 66 of the footing tool 52 are joined together by a third rectangular plate 68. The third plate 68 rests along and conforms with the back wall 35 and the bucket 26. As illustrated in FIG. 2, the far end or the rear end of the third plate 68 is provided with two apertures to which a pair of threaded fasteners or bolt means 70 can be inserted to join the tooth shaped member 56 directly to the bucket 26.

The hollow space defined by the three plates 62, 64 and 68 is preferably enclosed with two additional plate members 72 and 74. These two additional plate members 72 and 74 increase the overall strength and reduce the weight of the wedge-shaped member 56. Thus, when the five plates are welded together, a generally wedge-shaped hollow box is formed.

The width of the two plate members 62 and 64 defining the leading edge 66 of the footing tool 52 determines the width of the footing 50 dug in the base 43 of the trench 40. Preferably, the leading edge 66 of the footing tool 52 is forwardly disposed of leading edge 37 of the bucket 26 so as to present a rather sharp or pointed edge to the base 43 of the trench 40. When so formed, the leading edge 66 of the footing tool 52 digs into the base 43 of the trench 40 before the frame 54 engages the base of the trench. Thus, when the footing tool 52 is put into operation, the bucket 26 would be positioned relative to the base 43 of the trench 40 much as illustrated in FIG. 1. In other words, the leading edge 66 of the footing tool 52 would first engage or strike the base 43 of the trench 40. This would break loose some of the material or soil forming the base 43 of the trench 40. Then, as the dipper stick 21 or boom 16 is positioned to force the bucket 26 towards the base 43 of the trench 40, additional material would be uplifted by the footing tool 52.

At some point the frame 54 would engage the base 43 of the trench 40. Since the frame 54 presents a much wider edge or surface to the base 43 of the trench 40, additional resistance is experienced or sensed by the machinery operator positioning the bucket 26. At this point, he would "curl" the bucket 26 towards the dipper stick 21 in such a manner that the bucket 26 would be oriented relative to the trench 40 much as shown in FIG. 3. That is, the frame 54 of the footing tool 52 would be resting along the base 43 of the trench 40 and the back wall 35 of the bucket 26 would also be resting along the base 43 of the trench 40. Together the frame 54 and the back wall 35 effectively guide or position the leading edge 66 of the footing means 56 at the correct distance below the base 43 of the trench 40. The operator of the backhoe 10 needs only to continue to drag or force the bucket 26 towards the tractor 9.

As the footing means 56 uplifts material or soil, much as a plow, that material is funneled or channeled into the interior of the bucket 26. When the bucket 26 is filled, the operator of the backhoe 10 needs only to curl the bucket towards the dipper stick 21 to contain the uplifted material in the interior of the bucket. The bucket 26 would then be positioned much as illustrated in FIG. 4. The bucket 26 would be uplifted out of the trench and the uplifted material would be discharged in the usual manner. The cycle would be repeated as often as necessary to provide the necessary footing 50 in the trench 40.

It should be appreciated from the foregoing detailed description that, when the footing tool 52 is used to dig trenches for the purpose of laying conduit, drainpipe and the like, the overall efficiency of the backhoe 10 is improved and the productivity of the operator is increased. Since the footing tool 52 can be easily attached to the bucket 26 by virtue of the bolt means 58 and 70, the footing tool presents an attractive investment for those contractors who engage in such work. Thus, in accordance with the present invention, a unique and novel apparatus has been disclosed that is especially suited for digging a footing at the base of a trench.

While the invention has been described in conjunction with certain specific embodiments, it is evident that there are many alternatives, modifications, variations which will be apparent to those skilled in the art in light of the foregoing detailed description. Accordingly it is intended to cover all such alternatives, modifications, and variations as set forth within the spirit and broad scope of the appended claims.

What is claimed is as follows:

1. Digging apparatus suitable for use with implements using a pivoting arm to operate a bucket in digging a trench in soil, comprising:

(a) a bucket adapted to be connected to said arm and defining two side walls and a backwall, one edge of which is the leading edge of said bucket, (b) footing means, carried by said bucket, for excavating a channel at the base of the trench dug by said bucket, said footing means defining a downwardly disposed first leading edge lying in advance of the leading edge of said bucket and having a width less than the width of said bucket, whereby said bucket when thrust forward into the soil drives said first leading edge into the soil where it breaks loose a portion of the soil beneath the leading edge of the bucket, that portion of the soil broken loose by said footing means being funneled into said bucket by the leading edge of the bucket while leaving an elongated groove along the path of the bucket, the width of said groove being less than the width of the trench formed by said bucket, said footing means including a first plate member and a second plate member, said first plate member and said second plate member defining complementary edges, said first plate member and said second plate member being joined together along said complementary edges to define said first leading edge, said first leading edge of said footing means lying forwardly and downwardly relative to the leading edge of said bucket when the leading edge of the bucket lies along the base of said trench.

2. The apparatus as set forth in claim 1, wherein said first plate member defines two generally straight parallel edges, one of which is disposed along the leading edge of said bucket, the other of which forms a part of said first leading edge.

3. The apparatus as set forth in claim 1, wherein said second plate member defines two generally straight parallel edges, one of which is disposed adjacent the back wall of said bucket, the other of which forms a part of said first leading edge.

4. The apparatus as set forth in claim 1, further including wall means for enclosing the space defined by the first plate member, said second plate member and said bucket.

* * * * *